US007997953B2

(12) United States Patent
Kamiya et al.

(10) Patent No.: US 7,997,953 B2
(45) Date of Patent: Aug. 16, 2011

(54) PRECISION MACHINING METHOD

(75) Inventors: Sumio Kamiya, Toyota (JP); Hisao Iwase, Aichi (JP); Tetsuya Nagaike, Toyota (JP); Hiroshi Eda, Kasama (JP); Libo Zhou, Hitachi (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 931 days.

(21) Appl. No.: 11/887,786

(22) PCT Filed: Apr. 4, 2006

(86) PCT No.: PCT/JP2006/307518

§ 371 (c)(1),
(2), (4) Date: Oct. 3, 2007

(87) PCT Pub. No.: WO2006/107111

PCT Pub. Date: Oct. 12, 2006

(65) Prior Publication Data

US 2009/0047869 A1 Feb. 19, 2009

(30) Foreign Application Priority Data

Apr. 4, 2005 (JP) ..... 2005-107821

(51) Int. Cl.
*B24B 49/00* (2006.01)

(52) U.S. Cl. ..... 451/5; 451/10; 451/11; 451/41; 451/58; 451/254

(58) Field of Classification Search ..... 451/5, 8, 451/9, 10, 11, 41, 44, 57, 58, 65, 242, 246, 451/254, 285, 287, 289
See application file for complete search history.

(56) References Cited

U.S. PATENT DOCUMENTS 3,683,558 A * 8/1972 Oishi ..... 451/239
3,748,789 A * 7/1973 Wada et al. ..... 451/14
3,919,614 A * 11/1975 Wespi ..... 318/571
4,670,964 A * 6/1987 Bleich ..... 483/33

(Continued)

FOREIGN PATENT DOCUMENTS

CN 1562564 1/2005

(Continued)

OTHER PUBLICATIONS

Zhou, L. et al., "A Novel Fixed Abrasive Process: Chemo-Mechanical Grinding Technology," Int. J. Manufacturing Technology and Management, vol. 7, Nos. 5/6, pp. 441-454, (2005).

(Continued)

*Primary Examiner* — Eileen P. Morgan
(74) *Attorney, Agent, or Firm* — Finnegan, Henderson, Farabow, Garrett & Dunner, LLP

(57) ABSTRACT

A precision machining method enabling grinding with high accuracy is provided. The method includes a first step of producing an intermediate ground workpiece by roughly grinding a workpiece (a) with a diamond grinding wheel (b), and a second step of producing a final ground workpiece by grinding the intermediate ground workpiece with a grinding wheel for CMG. In the first step, feed of the rotator (6*b*) and the base (3) is controlled in multiple stages with different feed speeds according to control based on the amount of movement, and in the second step, movement of the rotator (6*b*) and the base (3) is controlled with a constant pressure or in multiple stages having different constant pressures.

3 Claims, 14 Drawing Sheets

U.S. PATENT DOCUMENTS 6,183,344 B1 * 2/2001 Tsuchimoto et al. ..... 451/5

FOREIGN PATENT DOCUMENTS

| | | |
|---|---|---|
| JP | 63-245369 | 10/1988 |
| JP | 63-288655 | 11/1988 |
| JP | 2000-141207 | 5/2000 |
| JP | 2000-288929 | 10/2000 |
| JP | 2001-260014 | 9/2001 |
| JP | 2002-134450 | 5/2002 |
| JP | 2002-239881 | 8/2002 |
| JP | 2002-355763 | 12/2002 |
| JP | 2003-103441 | 4/2003 |
| JP | 2003-251555 | 9/2003 |
| JP | 2004-322247 | 11/2004 |
| JP | 2004-349675 | 12/2004 |
| JP | 2005-021998 | 1/2005 |
| JP | 2006-181694 | 7/2006 |
| JP | 2006-181703 | 7/2006 |
| JP | 2006-281412 | 10/2006 |
| JP | 2007-038358 | 2/2007 |

OTHER PUBLICATIONS

Zhou, L. et al., "Chemo-Mechanical-Grinding (CMG)," Research on Chemo-Mechanical-Grinding (CMG)of Si Wafer, 1st Report: Development of CMG Wheel, The Japan Society of Precision Engineering, vol. 68, No. 12, pp. 1559-1563, (2002).

Zhou, L. et al., "Development and Evaluation of CMG Wheels Made by Electrophoretic Deposition," Journal of The Japan Society of Abrasive Technology, vol. 50, No. 3, pp. 35-39, (Mar. 2006).

Zhou, L. et al., "Chemo-Mechanical-Grinding (CMG)," Research on Chemo-Mechanical-Grinding (CMG) of Si Wafer, 2nd Report: Generation of Defect Free Surface on Φ300mm Si Wafer by Fixed Abrasive Process, The Japan Society for Precision Engineering, vol. 71, No. 4, pp. 466-470, (2005).

Zhou, L. et al., "Development of Chemo-Mechanical Grinding (CMG) Process," International Conference on Leading Edge Manufacturing in 21st Century, pp. 315-320, (Nov. 3-6, 2003).

Zhou, L. et al., "Development of Chemo-Mechanical Grinding (CMG) Process (Surface and Sub-Surface Analysis of Si Wafer Produced by CMG)," International Conference on Leading Edge Manufacturing in 21st Century, pp. 889-892, Oct. 19-22, 2005).

Zhou, L. et al., "Defect-Free Fabrication for Single Crystal Silicon Substrate by Chemo-Mechanical Grinding," Annals of the CIRP, vol. 55, No. 1, pp. 57-60, (2006).

Kamiya, S. et al., "Microstructural Analysis for Si Wafer After CMG Process," Key Engineering Materials, vol. 329, pp. 367-372, (2007).

Zhou, L. et al., "Study on Structure Transformation of Si Wafer in Grinding Process," Key Engineering Materials, vol. 329, pp. 373-378, (2007).

Okabe, H. et al., "Experimental and Simulation Research on Influence of Temperature on Nano-Scratching Process of Silicon Wafer," Key Engineering Materials, vol. 329, pp. 379-384, (2007).

Okubo, H. et al., "Simulation on Planarization Process of Patterned Si Wafer (Improvements in Accuracy of Simulation Model)," International Conference on Leading Edge Manufacturing in 21st Century, pp. 883-888, (Oct. 19-22, 2005).

Zhou, L. et al., "Simulation on Planarization Process of Patterned Si Wafer (Establishment of an Analytical Model)," Transaction of the Japan Society of Mechanical Engineers, No. 04-0639, pp. 371-376, (2005). Abstract.

Zhou, L. et al., "Effects of Tool Stiffness and Infeed Scheme on Planarisation (Integrated Model for Simulation of Planarisation Process)," Int. J. Manufacturing Technology and Management, vol. 7, Nos. 5/6, pp. 490-503, (2005).

Hosseini, B. S. et al., "Study of Subsurface Damage Generated in Ground Si Wafer," The Japan Society For Precision Engineering, 11th International Conference on Precision Engineering, pp. 309-313, (Aug. 2006).

Eda, H. et al., "Plastic-Strain Reducing Machining and Evaluation of Perfect Surface Creating Machining of Φ300 Si Wafer," Monthly Publication: The Tribology, 56-58, (2007).

Zhou, L. et al., "Fabrication and Evaluation for Extremely Thin Si Wafer," Int. J. Abrasive Technology, vol. 1, No. 1, pp. 94-105, (2007).

Chinese Office Action dated Feb. 6, 2009.

* cited by examiner

Cross-sectional TEM Image

Acceleraling Voltage : 200KeV
Live Time : 116 seconds

Take Off Angle : 25°
Dead Time : 8.547

Acceleraling Voltage : 200KeV
Live Time : 95 seconds

Take Off Angle : 25°
Dead Time : 6.637

(a)

(b)

(a)

(b)

Halo of SiO amorphous phase

PRECISION MACHINING METHOD

TECHNICAL FIELD

The present invention relates to a precision machining method for machining articles which include a silicon wafer and a magnetic disk substrate and require high dimensional accuracy and flat finished surfaces, and particularly relates to a precision machining method enabling efficient grinding with high accuracy by performing switching control on, for example, a rotator of a grinding wheel through step-by-step feed control or step-by-step pressure control in response to a grinding step.

BACKGROUND ART

In recent years, next-generation power devices with lower energy loss and miniaturization have grown in demand. For example, multiple layers and higher densities have been demanded of semiconductors for electronics. In response to these demands, the following solutions are considered: semiconductor wafers typified by a Si wafer are greatly reduced in thickness, a machining method causing no dislocations or lattice distortions on a work surface or inside the work surface is developed, and a machining method having a surface roughness (Ra) of sub-nm (sub-nanometers) to nm (nanometers) and a degree of flatness of sub-μm (sub-micrometers) to μm (micrometers) or lower on a work surface is developed.

In automobile industry, IGBTs (Integrated Bipolar Transistors) acting as power devices in automobiles are main systems of inverter systems. In the future, it is expected that higher performance and miniaturization of such inverters will further enhance the salability of hybrid cars. Thus it is necessary to reduce the thickness of a Si wafer making up an IGBT to 50 μm to 150 μm, desirably to about 90 μm to 120 μm to reduce a switching loss, a steady loss, and a heat loss. Further, a perfect surface having no dislocations or lattice distortions is formed on the work surface of a circular Si wafer having a diameter of about 200 mm to 400 mm or in an interior close to the work surface, the surface roughness (Ra) is set at sub-nanometers to nanometers, and the degree of flatness is set at sub-micrometers to micrometers, so that yields in an electrode forming process of semiconductors improve and the number of layers of semiconductors increases.

Generally, the machining process of semiconductors requires a number of steps under present circumstances and so on (for example, patent document 1). The steps include rough grinding with a diamond grinding wheel, lapping, etching, and polishing (Wet-CMP (Chemo Mechanical Polishing) using free abrasive grains). In this conventional machining method, an oxidation layer, dislocations, and lattice distortion occur on a work surface. Thus it is quite difficult to obtain a perfect surface. Moreover, the flatness of a wafer is low and the yields are reduced by a break on a wafer during machining or after an electrode is formed. Additionally, in the conventional machining method, it is difficult to reduce the thickness of a wafer as the diameter of the wafer increases to 200 mm, 300 mm, and 400 mm. Thus under present circumstances, studies have been conducted to reduce the thickness of a 200 mm diameter wafer to 100 μm.

In view of the problems of the conventional art, the present inventors have disclosed an invention relating to a precision surface working machine which can efficiently perform a process ranging from rough machining to ultraprecision surface machining including the final ductile mode machining, only with a precision diamond grinding wheel (patent document 2).

In grinding using such a diamond grinding wheel, three main actions including the rotation of the grinding wheel, the feed of a main spindle for supporting the grinding wheel, and the positioning of a workpiece are important. Precise control on these actions enables precision machining. Particularly, in order to consistently perform a process from rough machining to ultraprecision machining only with a single device, it is necessary to accurately control, of the main actions, the feed of the main spindle over a wide range. In conventional grinding, main spindles are frequently controlled by, for example, methods using servomotors. Such methods cannot sufficiently control areas from a low-pressure area to a high-pressure area with high accuracy, particularly in machining on a low-pressure area where ultraprecision machining is to be performed.

Thus in patent document 2, the present inventors have disclosed a precision machine tool for controlling a pressure with a combination of a servomotor and a super-magnetostrictive actuator. In a pressure range of 10 gf/cm$^2$ or larger, the pressure is controlled by a servomotor and a piezoelectric actuator. In a pressure range of 10 gf/cm$^2$ to 0.01 gf/cm$^2$, the pressure is controlled by a super-magnetostrictive actuator, so that rough machining to ultraprecision machining can be consistently performed by a single device. Further, as a grinding wheel for grinding, a diamond cup grinding wheel having an abrasive grain size smaller than #3000 is used.

Moreover, the present inventors have conducted studies in view of the problems of CMP and found that the problems can be effectively solved by using a synthetic grinding wheel which contains compounds reactive to fine abrasive grains and a workpiece. The compounds are fixed by a specific binder. The inventors have disclosed an invention relating to the synthetic grinding wheel in patent document 3. Grinding using the synthetic grinding wheel is referred to as chemical mechanical grinding (CMG).

Patent Document 1
JP Patent Publication (Kokai) No. 2003-251555
Patent Document 2
JP Patent Publication (Kokai) No. 2000-141207
Patent Document 3
JP Patent Publication (Kokai) No. 2002-355763

DISCLOSURE OF THE INVENTION

According to the precision machine tool of patent document 2, rough machining to ultraprecision machining can be consistently performed by a single device. However, grinding only using a diamond grinding wheel cannot form the final finished surface into a perfect surface having no defects, no dislocations, or no lattice distortions.

The present invention is designed in view of the problem. An object of the present invention is to provide a precision machining method which achieves efficient grinding with extremely high precision by combining control based on an amount of movement of a grinding wheel or a workpiece to be ground and control based on a pressure (constant pressure), and selectively using a diamond grinding wheel and a grinding wheel for CGM according to a machining step.

In order to attain the object, the precision machining method of the present invention uses a precision machining system comprising a rotator for rotating a workpiece to be ground, a first base for supporting the rotator, a rotator for rotating a grinding wheel, and a second base for supporting the rotator, the first base and/or the second base further comprising movement adjusting means capable of moving one of the bases to the other base, the movement adjusting means being capable of selectively performing control based on an amount of movement and control based on a pressure, the method comprising: a first step of producing an intermediate ground workpiece by grinding the workpiece with a diamond grinding wheel; and a second step of producing a final ground workpiece by grinding the intermediate ground workpiece with a grinding wheel for CMG; wherein in the first step, the feed of the rotator and the base is controlled in multiple stages with different feed speeds according to the control based on the amount of movement, and in the second step, the movement of the rotator and the base is controlled with a constant pressure or in multiple stages having different constant pressures.

In the precision machining system used in the precision machining method of the present invention, the rotator for rotating the workpiece to be ground while holding the workpiece and the rotator for rotating the grinding wheel are placed on the respective bases, and the work surface of the workpiece to be ground and a surface of the grinding wheel are opposed to each other. The workpiece to be ground and the grinding wheel are positioned such that the axes of the workpiece and the grinding wheel are aligned with each other. For example, the first base for supporting the rotator for rotating the workpiece to be ground is fixed and the rotator for rotating the grinding wheel is moved to the workpiece while the second base for supporting the rotator is controlled according to an amount of movement or with a constant pressure in response to a machining step, so that the surface of the workpiece is ground. Another method of grinding a workpiece with a grinding wheel is available, in which the workpiece is ground while the axial directions of the workpiece and the grinding wheel are aligned with each other and the grinding wheel is slid in the orthogonal direction to the axis (horizontal direction).

For example, in an embodiment where the second base for supporting the grinding wheel is moved to the workpiece to be ground, a feed screw and a nut which make up a so-called feed screw mechanism are attached to the second base, and a suitable pneumatic actuator or hydraulic actuator is attached to the second base. In the feed screw mechanism, the nut is movably screwed onto the feed screw attached to the output shaft of a servo motor and the nut is attached to the second base, so that the second base moves in a controllable manner. The feed screw means and the actuator can be properly selected in response to a grinding step. For example, in the initial grinding step, the feed screw mechanism is selected until the surface of the workpiece to be ground has a certain surface roughness, and rotator (grinding wheel) on the second base moves to the workpiece according to a proper amount of movement of the nut, so that initial grinding is performed on the surface of the workpiece to be ground.

The initial grinding can have multiple grinding steps of a rough grinding step and the subsequent semi-finishing step (the semi-finishing step also includes two steps). In the initial grinding, a diamond grinding wheel is used in all the steps and the specifications are changed in each grinding step. The specifications of the diamond grinding wheel are changed by selecting grinding wheels so as to make finer abrasive grains step-by-step. For example, #400 to #800 grinding wheels are used in the rough grinding step and #3000 to #30000 grinding wheels are used in the semi-finishing step. Further, it is desirable to feed the grinding wheel with a different feed rate in each grinding step. According to experiments conducted by the inventors, it is understood that a machining time until a desired thickness is obtained can be considerably reduced by reducing the feed rate in two steps or three steps more than grinding with a constant feed rate, though the reduction varied depending upon the kind of used grinding wheel (commercial grinding wheels of various manufactures). Further, for example, when a Si wafer having an initial thickness of about 730 μm is ground to about 110 μm (final finishing), the following grinding steps can be used: the wafer is ground to about 180 μm in the rough grinding step of the initial grinding, is ground to 130 μm and 110 μm in two steps in the subsequent semi-finishing step, and is ground by 1 to 2 μm in the final finishing of CMG (described later).

At the completion of the initial grinding on the surface of the workpiece to be ground, a control mode is switched from control based on an amount of movement to constant pressure control in an ultraprecision grinding step (second step). When switching the control mode, the used grinding wheel is changed from a diamond grinding wheel to a grinding wheel for CMG for untraprecision grinding. The grinding wheel for CMG is formed of at least abrasive grains containing cerium oxide ($CeO_2$) or silica ($SiO_2$) and a resin binder for binding the abrasive grains. In the ultraprecision grinding step, the surface of the workpiece to be ground is finished by extremely fine grinding and thus the grinding wheel has to be pressed to the surface of the workpiece with a constant pressure during the grinding. In the ultraprecision grinding step, it is necessary to perform constant pressure grinding in multiple stages until a final finishing step while the surface of the workpiece to be ground is adjusted to enter a ductile mode and the pressure is gradually reduced. The constant pressure grinding can be achieved by using a pneumatic actuator or a hydraulic actuator. For example, when pressure control of 10 mgf/cm$^2$ to 5000 gf/cm$^2$ is requested, the pressure control is divided in two stages of a low-pressure area ranging from 10 mgf/cm$^2$ to 300 gf/cm$^2$ and a high-pressure area ranging from 300 gf/cm$^2$ to 5000 gf/cm$^2$, and two kinds of actuators can be selectively used for the respective pressure areas in the precision machining system, thereby achieving constant pressure control in multiple stages. In addition to the two-step constant control, the second step may be performed with a constant pressure or may be constant pressure control in three or more steps.

Further, in a preferred embodiment of the precision machining method according to the present invention, an attitude controller for controlling an attitude of the rotator is disposed between the rotator and the first base or between the rotator and the second base, and an angle deviation between the ground surface of the workpiece to be ground and the surface of the grinding wheel is properly corrected in the first step and the second step.

In this case, the embodiment of the precision machining system can be made up of a first face member extending in a plane including the X-axis and the Y-axis and a second face member arranged in parallel with the first face member with a clearance disposed between the face members. Between the first face member and the second face member, first actuators are disposed which extend in the Z-axis direction orthogonal to a plane including a sphere, the X-axis, and the Y-axis. To the second face member, second actuators are connected which extend in a proper direction in the plane including the X-axis and the Y-axis. The second face member can move relative to the first face member while bearing an object to be placed, and the sphere is bonded to the first face member or the second face member with an elastically deformable adhesive. Further, the first actuator and the second actuator each comprise a piezoelectric element and a super-magnetostrictive element.

It is preferable that the first face member and the second face member are both made of materials strong enough to support the weight of the object placed on the second face member and are formed of non-magnetic materials. Although the materials are not particularly limited, austenitic stainless steel (SUS) can be used. Also, the sphere disposed between the first face member and the second face member has to be made of materials strong enough to support at least the weight of the object placed on the second face member. Therefore, a material forming the sphere can be properly selected according to the set weight of the placed object. The example of the material includes a metal. Cutouts may be formed on the first face member and the second face member on points of contact with the sphere according to the shape of the sphere. Even when the cutouts are provided on the faces, a predetermined clearance is necessary between the first face member and the second face member. It is preferable to properly set this clearance so as to prevent the second face member from coming into contact with the first face member even when, for example, the second face member is inclined by the activation of the second actuator.

Between the first face member and the second face member, the sphere and the two first actuators are disposed to be placed on the apexes of a given triangle on a plane, and the second actuator is attached to at least one of the four sides of the second face member. With at least the three actuators, the second face member can have a three-dimensional displacement relative to the first face member while directly bearing the placed object. When the second face member is displaced, the adhesive on the surface of the sphere disposed below the second face member to support the second face member is elastically deformed, so that the displacement of the second face member can be a free displacement substantially in an unrestrained state.

The first actuator and the second actuator are both made up of a super-magnetostrictive element and a piezoelectric element. The super-magnetostrictive element is a rare-earth metal such as dysprosium and terbium and an alloy of iron and nickel. The element can be extended by about 1 μm to 2 μm by a magnetic field generated by applying current around a coil wound around the stick-like super-magnetostrictive element. Further, the super-magnetostrictive element can be used in a frequency domain of 2 kHz or less and has a response speed of picoseconds ($10^{-12}$ seconds). Further, the output performance of the super-magnetostrictive element is about 15 kJ/cm$^3$ to 25 kJ/cm$^3$, which is about 20 to 50 times that of a piezoelectric element (described later). The piezoelectric element is formed of titanate zirconate ($Pb(Zr,Ti)O_3$), barium titanate ($BaTiO_3$), lead titanate ($PbTiO_3$), and so on. The piezoelectric element can be used in a frequency domain of 10 kHz or more and has a response speed of nanoseconds ($10^{-9}$ seconds). The output power of the piezoelectric element is smaller than that of the super-magnetostrictive element and is suitable for accurate position control (attitude control) in a relatively light load area. Moreover, the piezoelectric element includes an electrostrictive element.

In all steps from the first step to the second step, an angle deviation between the ground surface of workpiece to be ground and the surface of the grinding wheel is properly corrected while the attitude controller is operated. Since the super-magnetostrictive element and the piezoelectric element both have high response speeds, the super-magnetostrictive element and the piezoelectric element are properly switched in the present invention such that the piezoelectric element is basically used and the super-magnetostrictive element is used when necessary. A slight misalignment between the axes is always detected and the detected slight misalignment undergoes numeric processing in a computer. And then, the misalignment is inputted to the actuators as a necessary amount of expansion and contraction of the super-magnetostrictive element (super-magnetostrictive actuator) and the piezoelectric element (piezoelectric actuator).

According to experiments conducted by the inventors, a comparison between diamond grinding with a slight misalignment and a state having no angle deviations proved that the degree of unevenness greatly varies between the work surfaces and a time required for CMG greatly changes with the variation in the degree of unevenness.

Further, in the preferred embodiment of the precision machining method according to the present invention, the workpiece fastened to the rotator is shifted from the first step to the second step without being unfastened from the rotator.

The workpiece is unfastened by a proper method such as vacuum suction. According to the examinations of the inventors, when the workpiece is unfastened during the transition from grinding with a diamond grinding wheel (first step) to grinding with a grinding wheel for CMG (second step), an uneven pattern remains on the surface of the intermediate ground workpiece produced in the first step, whereas when the workpiece is not unfastened, such an uneven pattern does not remain. It can be decided that the ground workpiece is distorted during unfastening by a residue stress generated in a diamond grinding step and the distortion causes the uneven pattern on the surface of the workpiece.

As is understood from the above explanation, according to the precision machining method of the present invention, a feed speed is changed step-by-step while a diamond grinding wheel is used during control based on an amount of movement, and a pressure is changed step-by-step while a grinding wheel for CMG is used during constant pressure control, achieving efficient grinding with high accuracy. Further, according to the precision machining method of the present invention, the attitude controller having the sphere disposed between the two face members properly corrects the attitude of the rotator during grinding, thereby further increasing grinding accuracy and improving grinding efficiency.

BRIEF DESCRIPTION OF THE DRAWINGS

FIG. 14(*a*) is a graph showing a portion A (near the surface) of FIG. 13;

FIG. 14(*b*) is a graph showing a portion B (inside) of FIG. 13;

FIG. 16(*a*) is a graph showing a portion A (near the surface) of FIG. 15;

FIG. 16(*b*) is a graph showing a portion B (inside) of FIG. 15;

FIG. 17(*b*) shows a selected-area electron diffraction pattern on the surface of the extra-thin wafer;

FIG. 18(*b*) shows a selected-area electron diffraction pattern on the surface of the wafer;

FIG. 20 shows, through an AFM, a three-dimensional image of the surface of the wafer obtained by the conventional CMP method.

Figure 1:
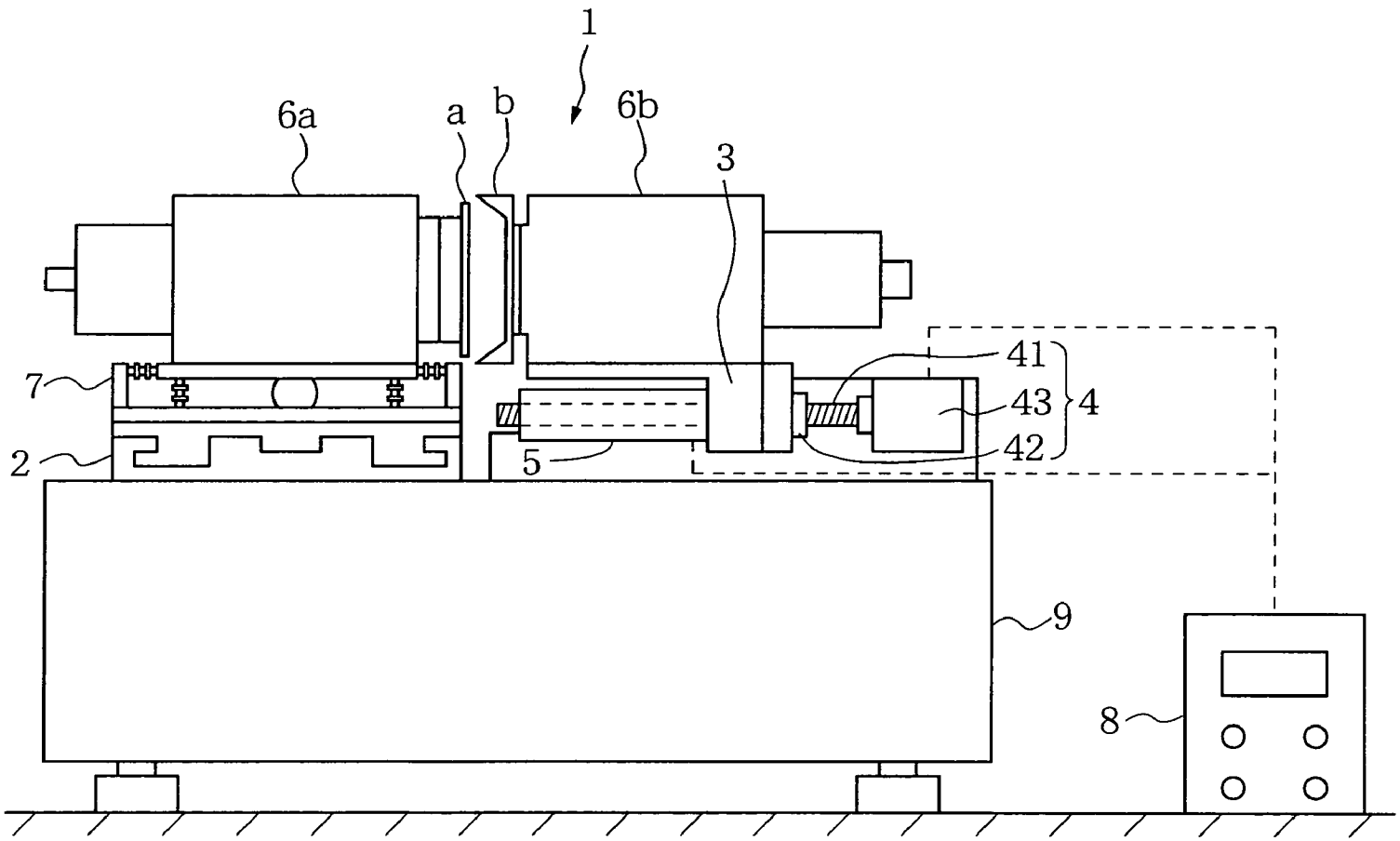
FIG. 1 is a side view showing an embodiment of a precision machining system of the present invention.

In the drawings, reference numeral 1 denotes a precision machining system, reference numeral 2 denotes a first base, reference numeral 3 denotes a second base, reference numeral 4 denotes feed screw means, reference numeral 41 denotes a feed screw, reference numeral 42 denotes a nut, reference numeral 43 denotes a servo motor, reference numerals 5, 5*a* and 5*b* denote pneumatic actuators, reference numeral 6*a* and 6*b* denote rotators, reference numeral 7 denotes an attitude controller, and reference numeral 8 denotes a controller.

BEST MODE FOR CARRYING OUT THE INVENTION

Figure 2:
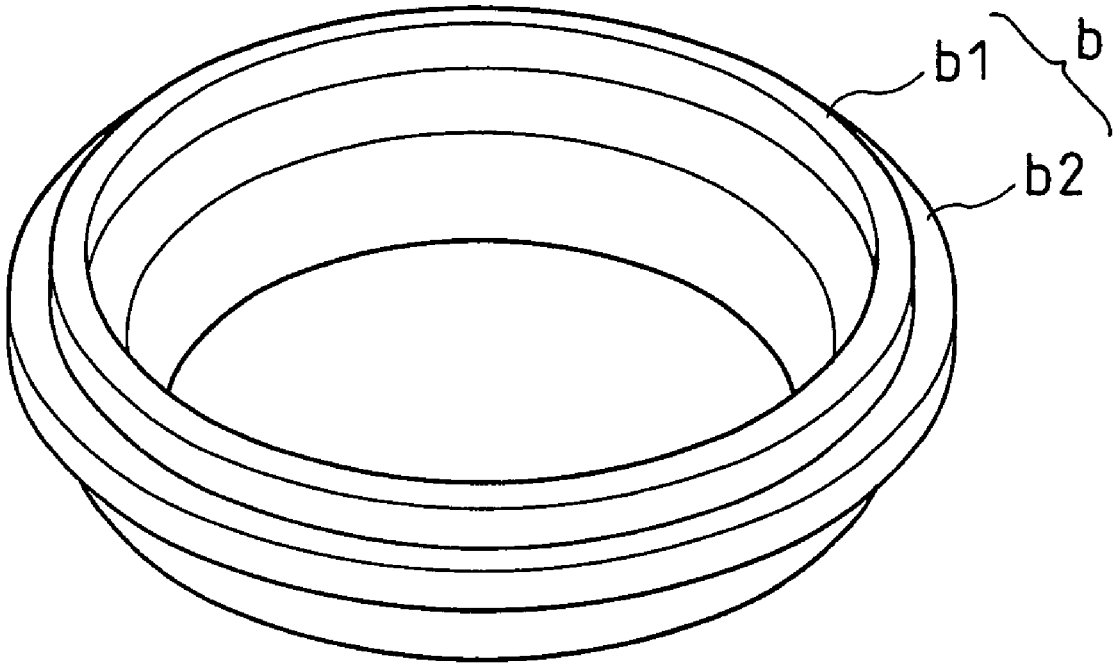
FIG. 2 is a perspective view showing an embodiment of a grinding wheel for CMG.
Figure 3:
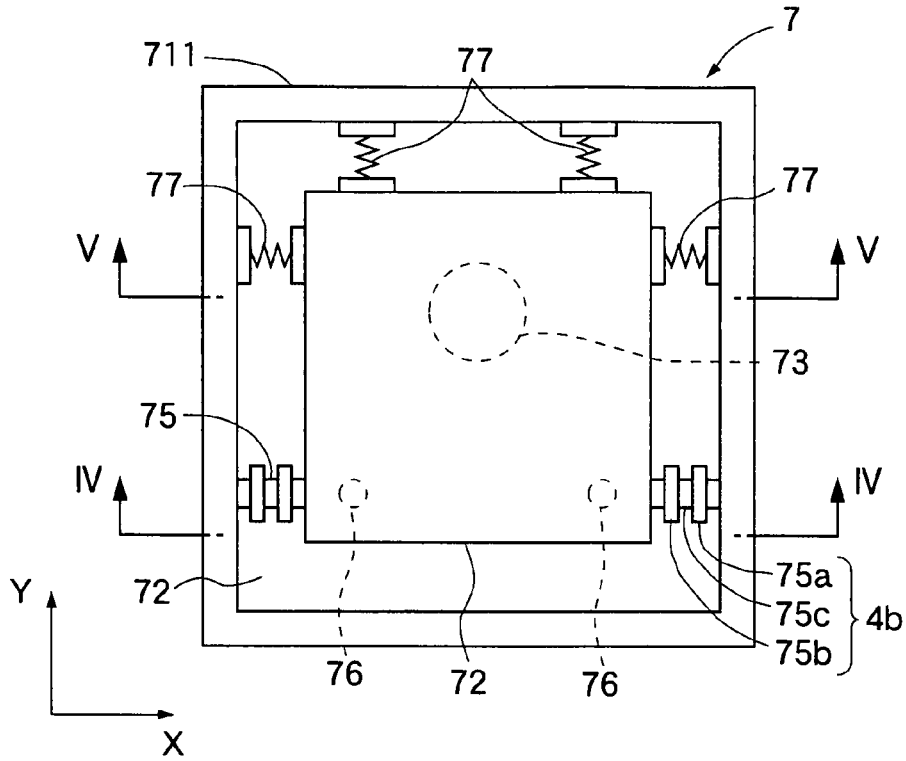
FIG. 3 is a plan view showing an embodiment of an attitude controller.
Figure 4:
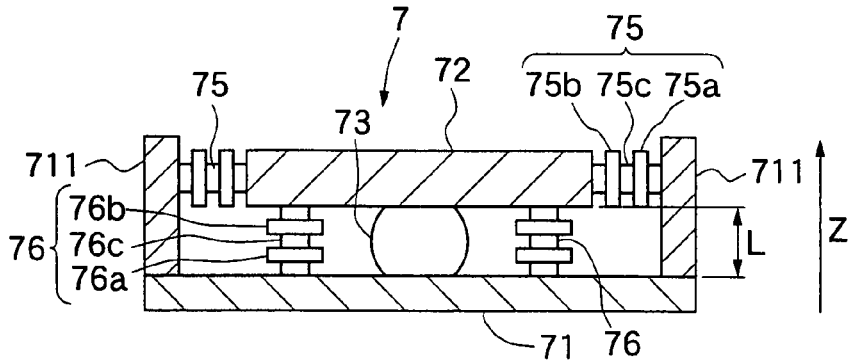
FIG. 4 is a view taken along line IV-IV of FIG. 3.
Figure 5:
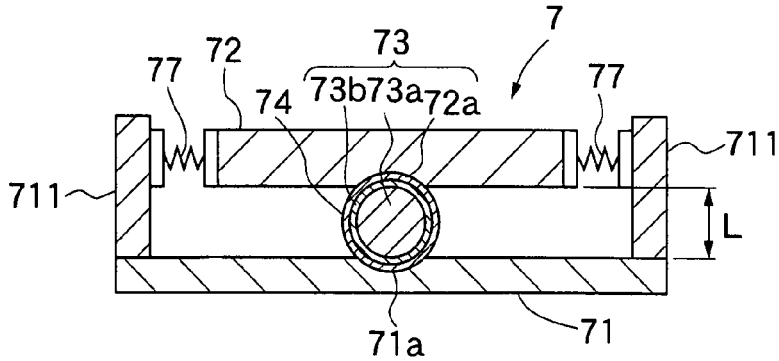
FIG. 5 is a view taken along line V-V of FIG. 3.
Figure 6:
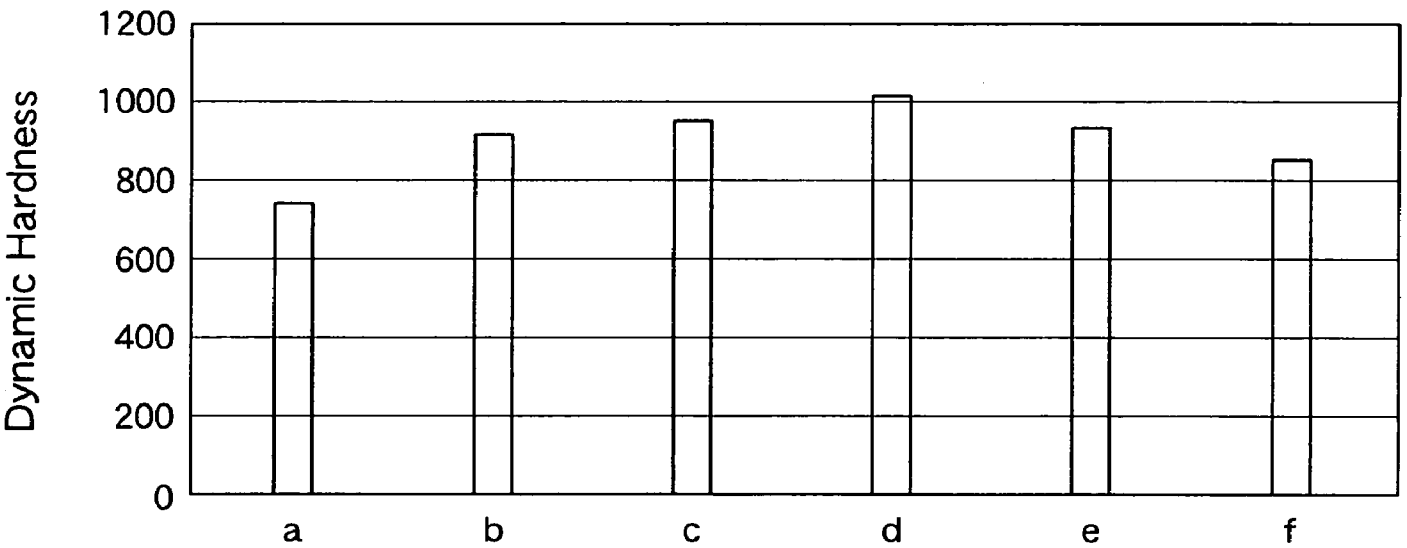
FIG. 6 is a graph for comparing the hardnesses of six kinds of test specimen skins (a: polishing surface, b: slicing surface, c: diamond grinding mirror surface, d: diamond grinding burn surface, e: CMG grinding surface (pH 7), f: CMG grinding surface (pH 11))
Figure 7:
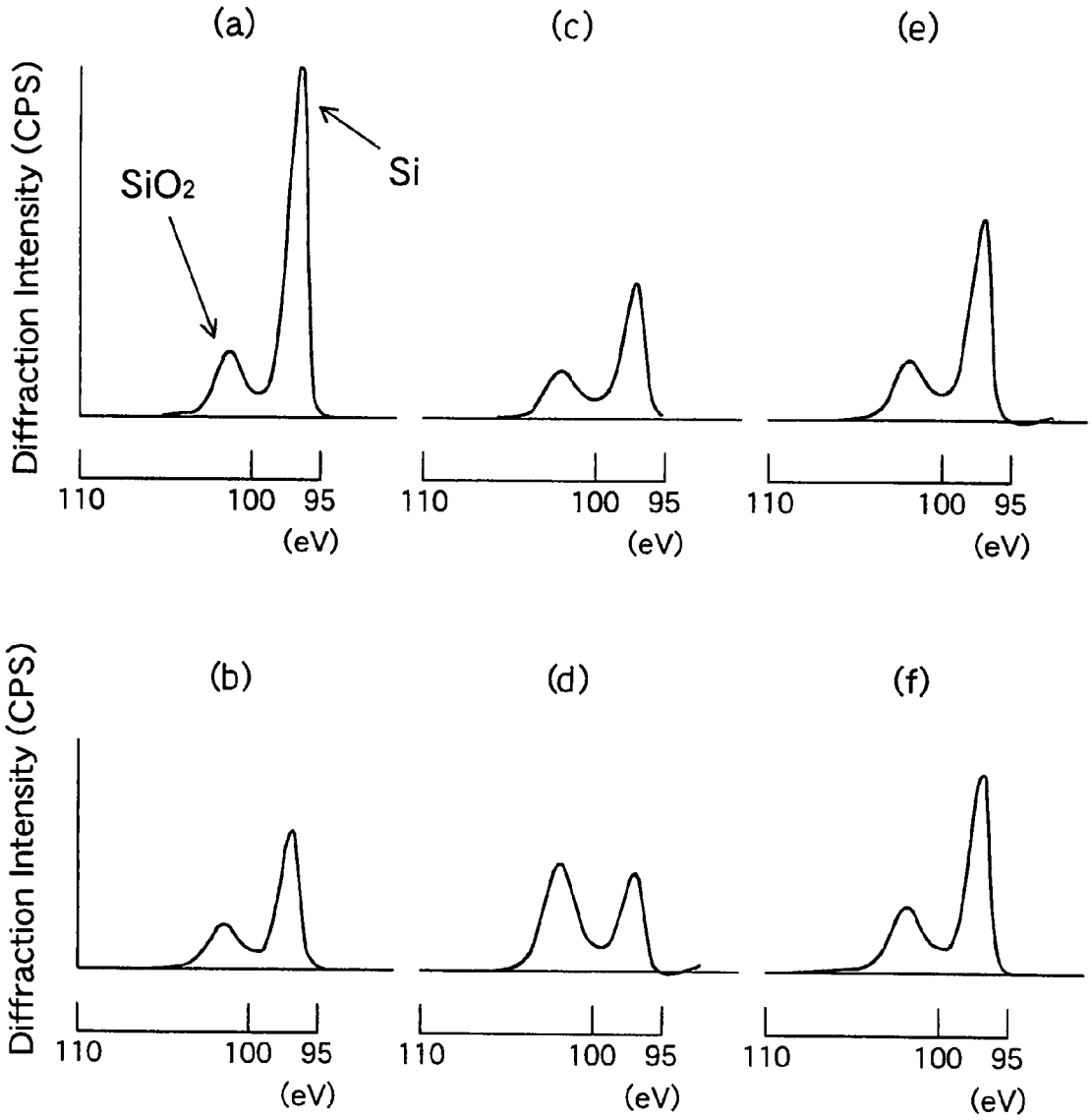
FIG. 7 shows XPS analysis results of six kinds of test specimen skins (the polishing surface, the slicing surface, the diamond grinding mirror surface, the diamond grinding burn surface, the CMG grinding surface (pH 11), and the CMG grinding surface (pH 7)) represented as (a) to (f)
Figure 8:
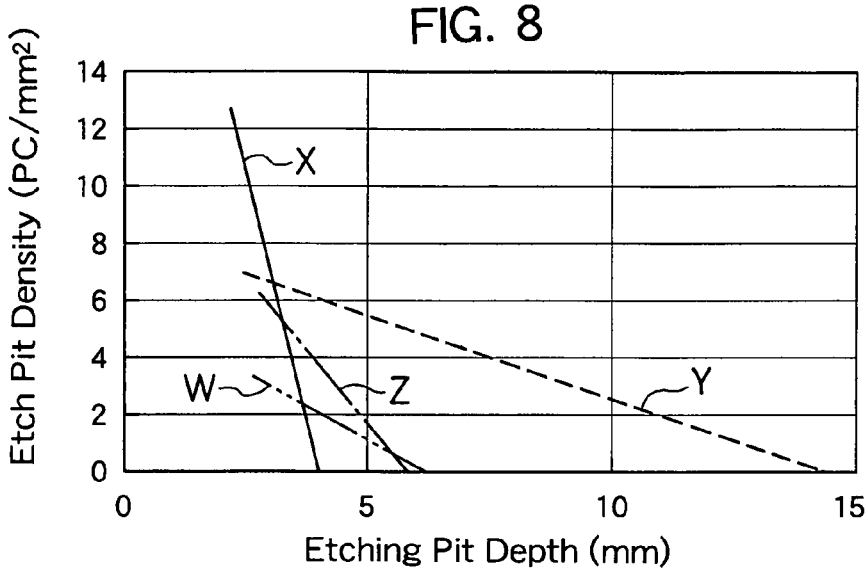
FIG. 8 is a graph showing the relationship between an etching depth and an etch pit density of each of four kinds of test specimen skins (a diamond grinding mirror surface, a diamond grinding burn surface, a CMG grinding surface (pH 11), and a CMG grinding surface (pH 7))
Figure 9:
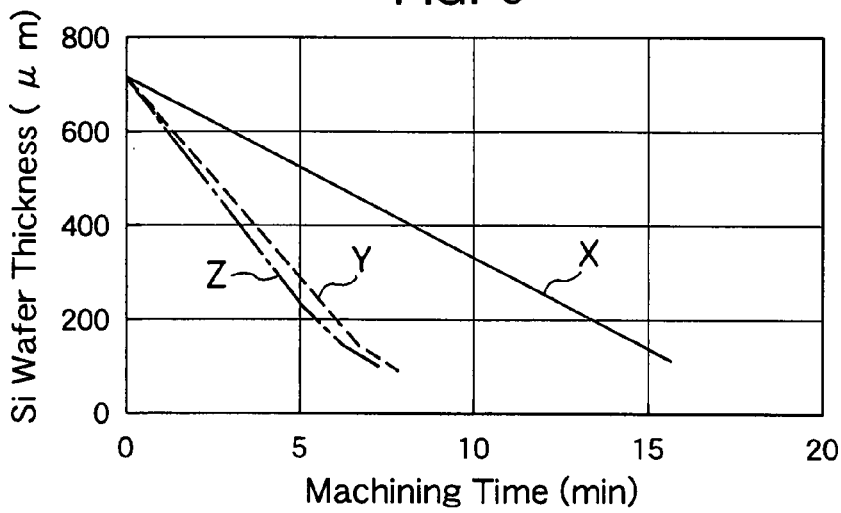
FIG. 9 is a graph for comparing the machining times of a fixed feed rate, a two-step feed rate, and a three-step feed rate in diamond grinding using a #400 diamond grinding wheel.
Figure 10:
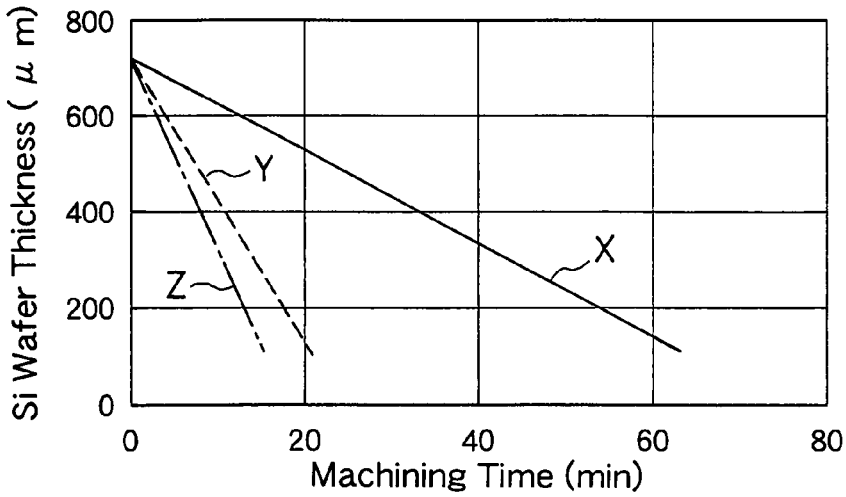
FIG. 10 is a graph for comparing the machining times of a fixed feed rate and a two-step feed rate in diamond grinding using a #800 diamond grinding wheel.
Figure 11:
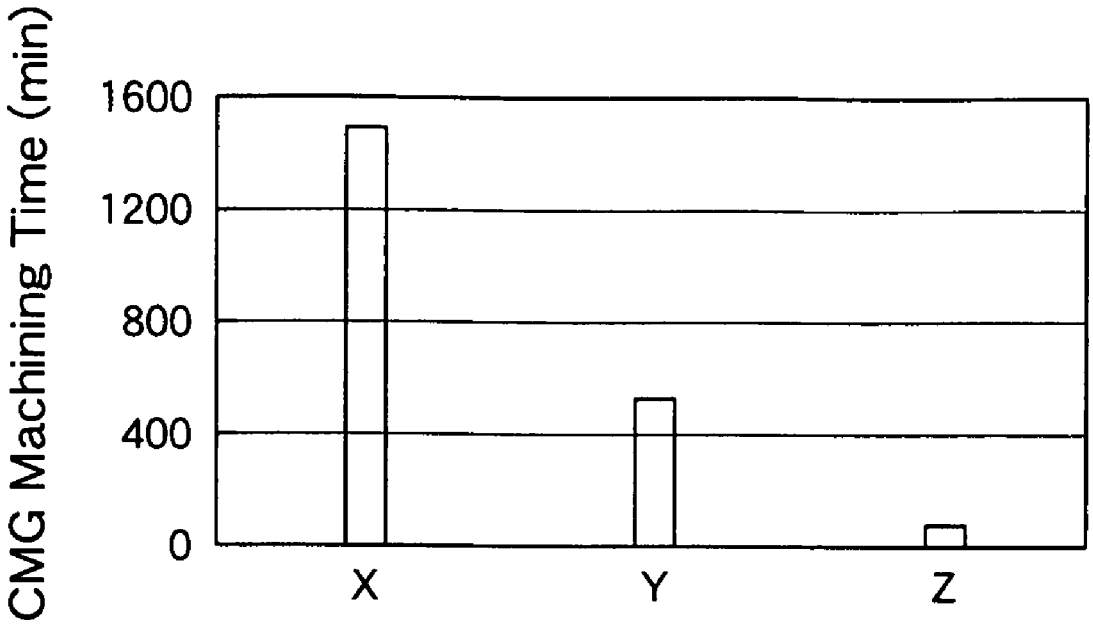
FIG. 11 is a graph for comparing machining times required for CMG relative to the roughness of the work surface of an intermediate workpiece to be ground.
Figure 12:
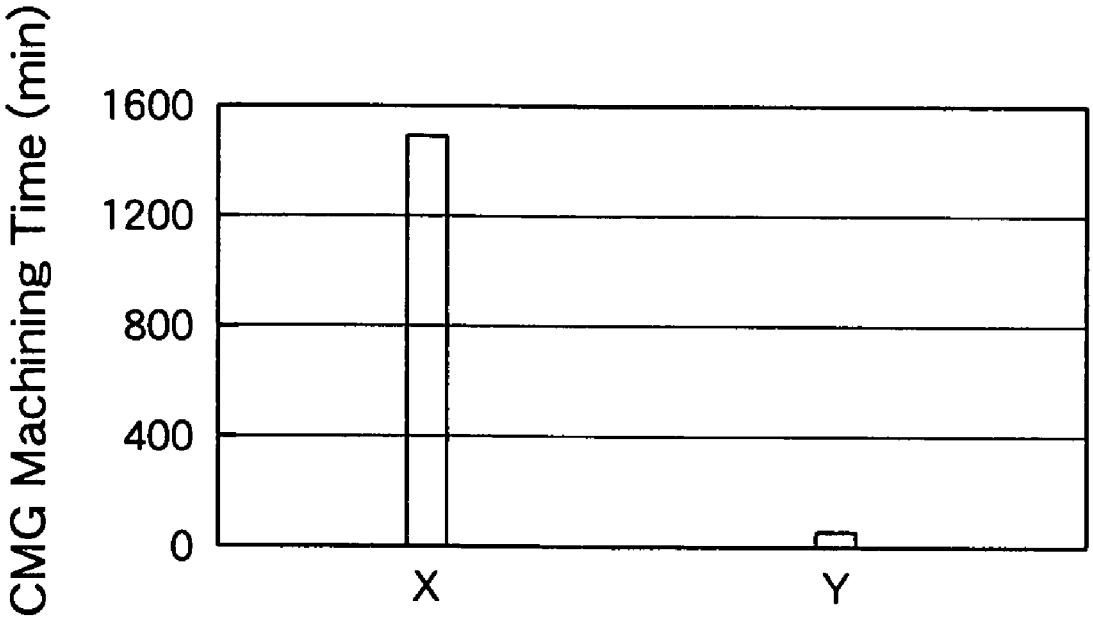
FIG. 12 is a graph for comparing machining times required for CMG in the presence and absence of an angle deviation between the ground surface of a workpiece to be ground and a surface of the grinding wheel in a first step.
Figure 13:
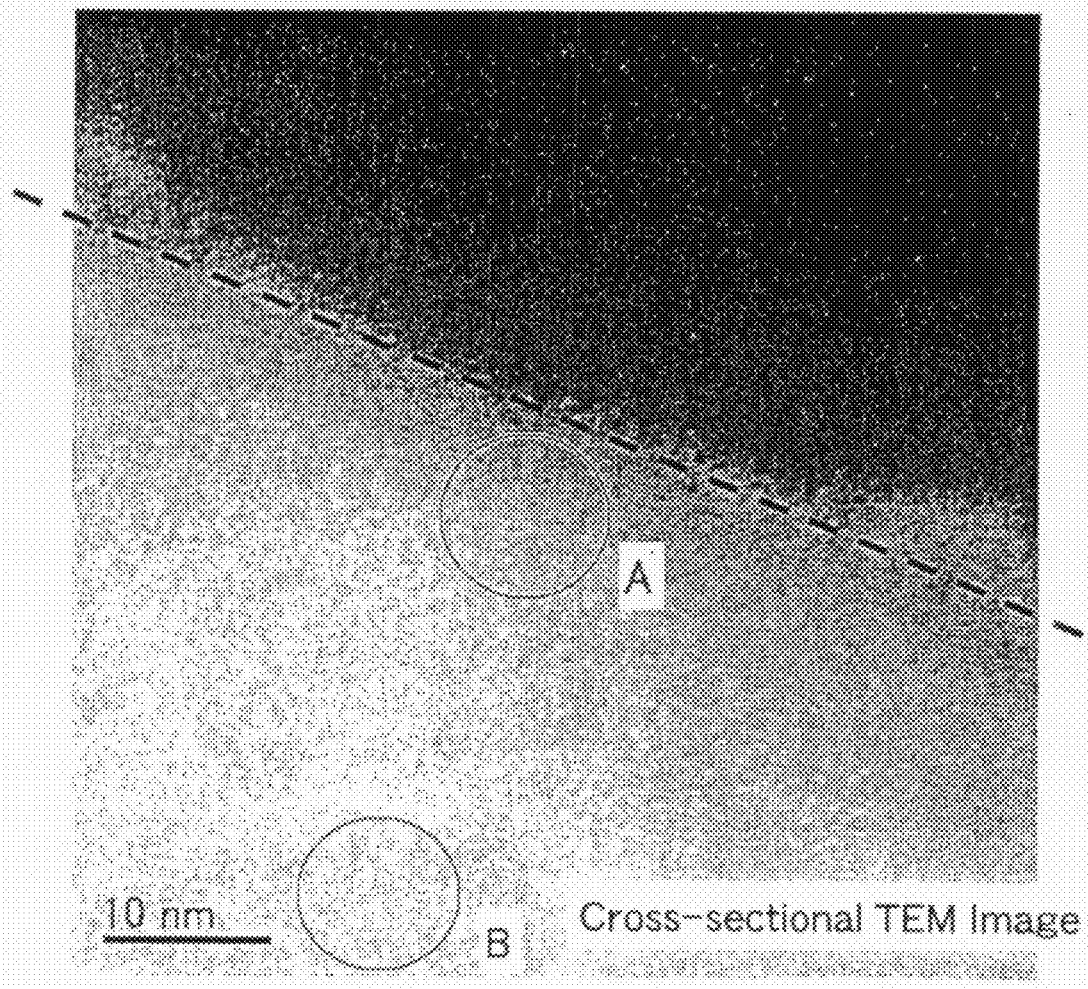
FIG. 13 shows a TEM image on the cross section of an extra-thin wafer obtained by CMG method.
Figure 14:
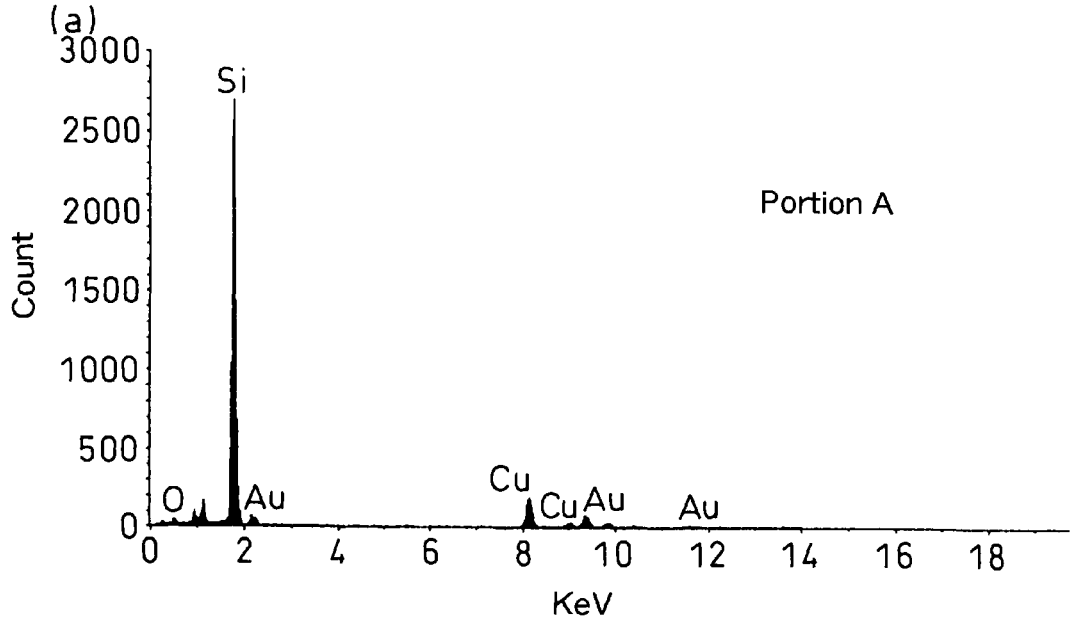
FIG. 14 show graphs for analyzing the presence or absence of lattice defects in FIG. 13.
Figure 14:
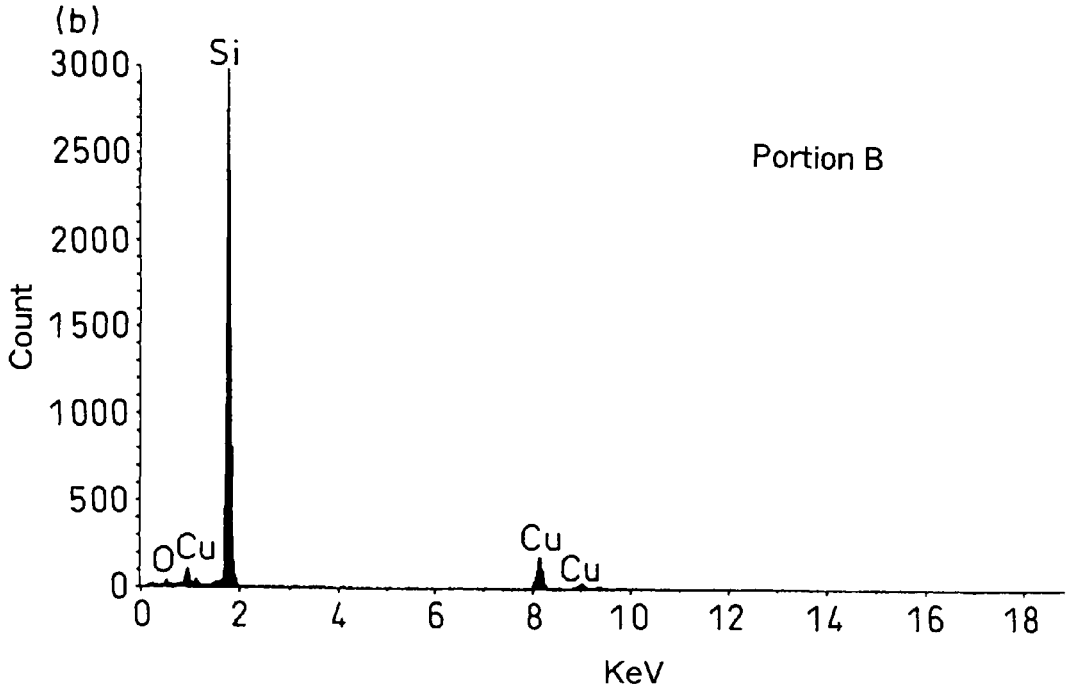
Figure 15:
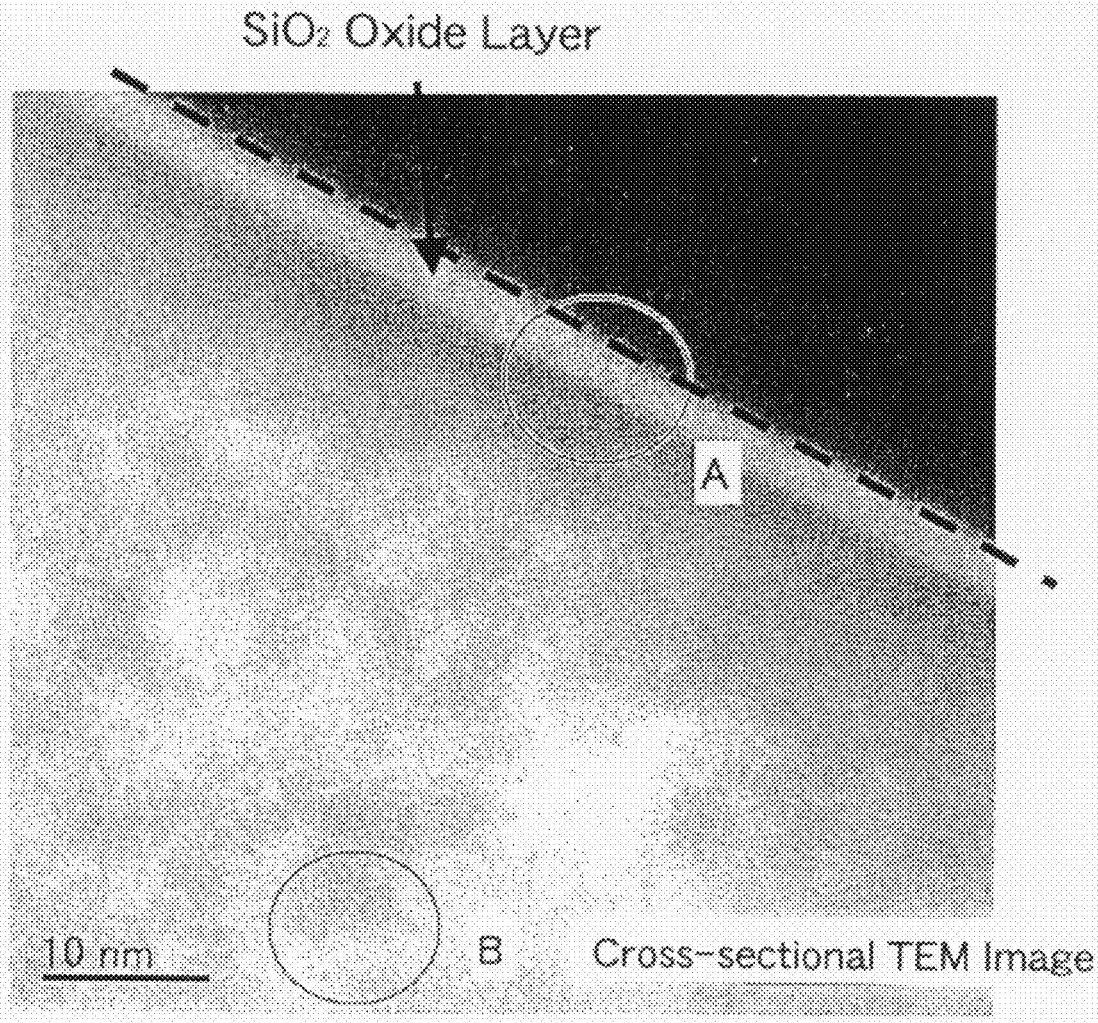
FIG. 15 shows a TEM image on the cross section of a wafer obtained by a conventional CMP method.
Figure 16:
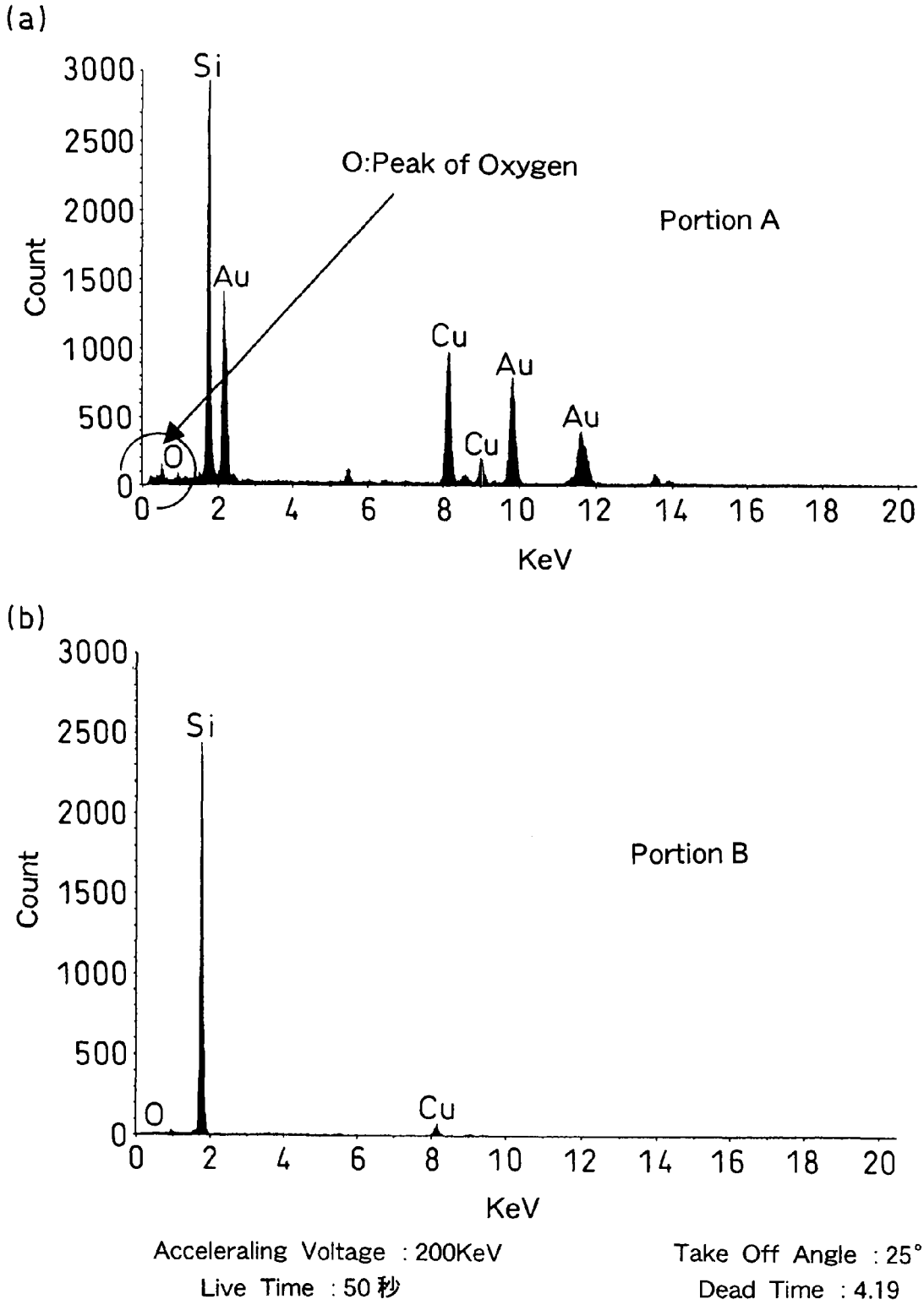
FIG. 16 show graphs for analyzing the presence or absence of lattice defects in FIG. 15.
Figure 17:
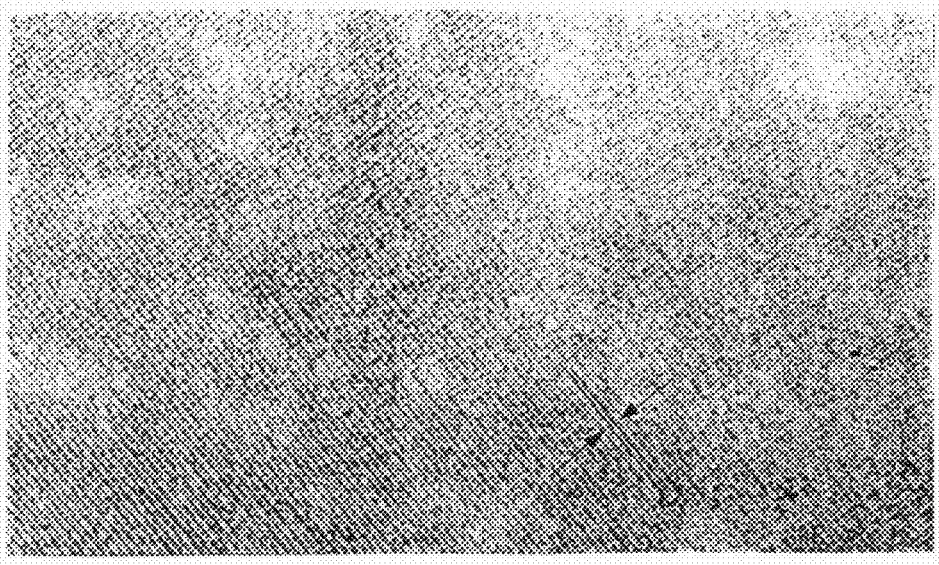
FIG. 17(*a*) shows a TEM image of a surface of an extra-thin wafer obtained by CMG method.
Figure 17:
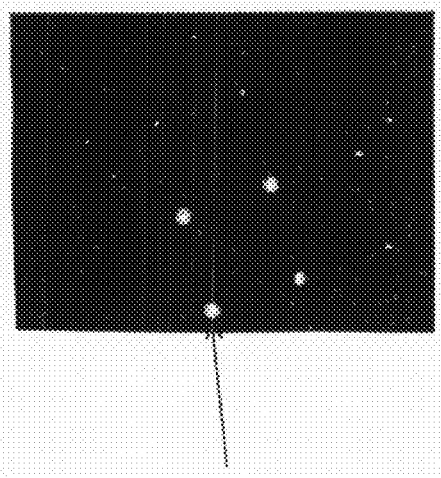
Figure 18:
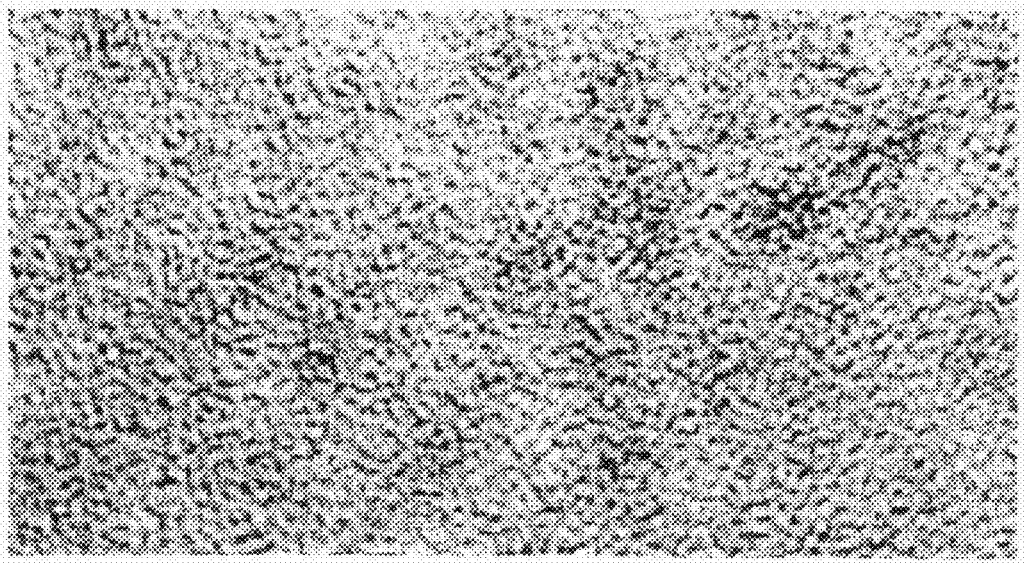
FIG. 18(*a*) shows a TEM image of the surface of the wafer obtained by CMP method.
Figure 18:
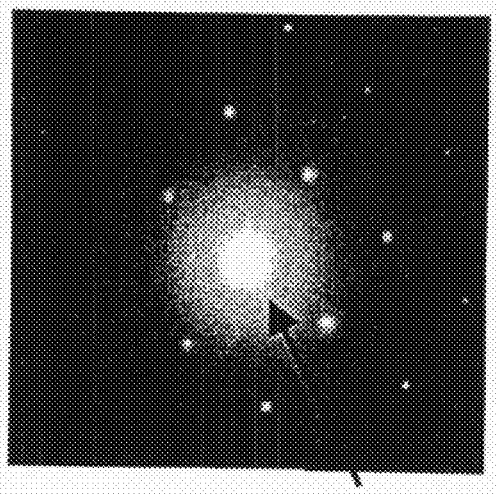
Figure 19:
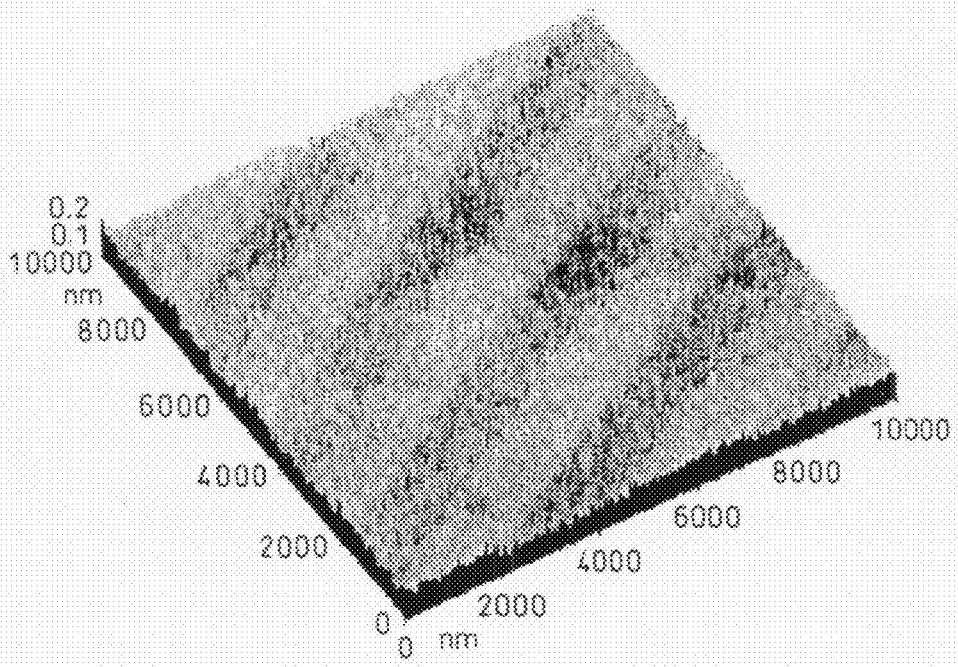
FIG. 19 shows, through an AFM, a three-dimensional image of the surface of the wafer obtained by CMG method.
Figure 2:
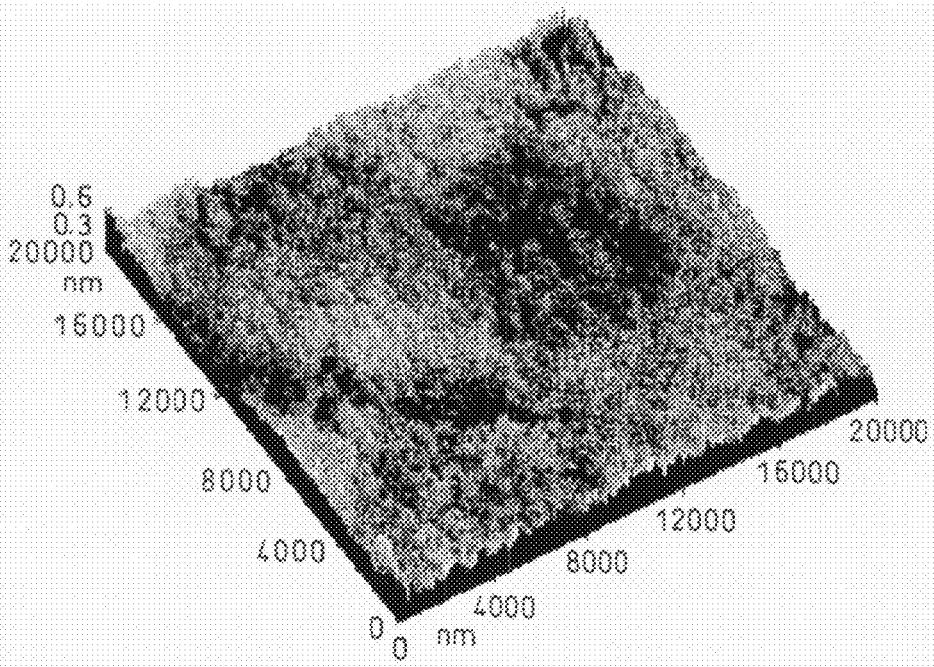

An exemplary embodiment of the present invention will now be described with reference to the accompanying drawings. FIG. 1 is a side view showing an embodiment of a precision machining system of the present invention. FIG. 2 is a perspective view showing an embodiment of a grinding wheel for CMG. FIG. 3 is a plan view showing an embodiment of an attitude controller. FIG. 4 is a view taken along line IV-IV of FIG. 3. FIG. 5 is a view taken along line V-V of FIG. 3. FIG. 6 is a graph for comparing the hardnesses of six kinds of test specimen skins (a polishing surface, a slicing surface, a diamond grinding mirror surface, a diamond grinding burn surface, a CMG grinding surface (pH 11), and a CMG grinding surface (pH 7)). FIG. 7 shows XPS analysis results of the six kinds of test specimen skins (the polishing surface, the slicing surface, the diamond grinding mirror surface, the diamond grinding burn surface, the CMG grinding surface (pH 11), and the CMG grinding surface (pH 7)). FIG. 8 is a graph showing the relationship between an etching depth and an etch pit density of each of four kinds of test specimen skins (a diamond grinding mirror surface, a diamond grinding burn surface, a CMG grinding surface (pH 11), and the CMG grinding surface (pH 7)). FIG. 9 is a graph for comparing the machining times of a fixed feed rate, a two-step feed rate, and a three-step feed rate in diamond grinding using a #400 diamond grinding wheel. FIG. 10 is a graph for comparing the machining times of a fixed feed rate and a two-step feed rate in diamond grinding using a #800 diamond grinding wheel. FIG. 11 is a graph for comparing machining times required for CMG relative to the roughness of the work surface of an intermediate workpiece to be ground. FIG. 12 is a graph for comparing machining times required for CMG in the presence and absence of an angle deviation between the ground surface of a workpiece to be ground and a surface of the grinding wheel in a first step. FIG. 13 shows a TEM image on the cross section of an extra-thin wafer obtained by CMG method. FIG. 14 show graphs for analyzing the presence or absence of lattice defects in FIG. 13. FIG. 15 shows a TEM image on the cross section of a wafer obtained by a conventional CMP method. FIG. 16 is a graph for analyzing the presence or absence of lattice defects in FIG. 15. FIG. 17*a* shows a TEM image of a surface of an extra-thin wafer obtained by CMG method. FIG. 17(*b*) shows a selected-area electron diffraction pattern on the surface of the extra-thin wafer. FIG. 18(*a*) shows a TEM image of a surface of a wafer obtained by CMP method. FIG. 18(*b*) shows a selected-area electron diffraction pattern on the surface of the wafer. FIG. 19 shows, through an AFM, a three-dimensional image of a surface of an extra-thin wafer obtained by CMG method. FIG. 20 shows, through an AFM, a three-dimensional image of a surface of a wafer obtained by the conventional CMP method. In the illustrated embodiment, a pneumatic actuator is used but a hydraulic actuator may be used instead. Further, three or more actuators may be provided according to pressure control.

FIG. 1 shows the embodiment of a precision machining system 1. The precision machining system 1 is mainly made up of a rotator 6*a* for rotating a workpiece a to be ground while sucking the workpiece "a" by vacuum, a first base 2 for supporting the rotator 6*a*, a second base 3 for supporting a rotator 6*b* for rotating a grinding wheel b, movement adjusting means for moving the second base 3 in the horizontal direction, and a pedestal 9 for supporting the first base 2 and the second base 3 from below. The grinding wheel b is a diamond grinding wheel in an initial grinding step (first step) and the grinding wheel b is a grinding wheel for CMG in a second step (ultraprecision grinding step). The initial grinding step is performed by feed control in multiple stages in which the grinding wheel b has different feed rates. In each feeding step, the grinding wheel b is replaced with another grinding wheel b having different specifications. FIG. 2 shows the embodiment of the grinding wheel for CMG. In FIG. 2, the grinding wheel b has a ring-shaped grinding wheel b1 fixed on an end of a ring-shaped frame b2 made of aluminum. The grinding wheel b1 is formed of at least abrasive grains containing cerium oxide ($CeO_2$) or silica ($SiO_2$) and a resin binder for binding the abrasive grains.

An attitude controller 7 is disposed between the first base 2 and the rotator 6*a*. The movement adjusting means is made up of feed screw means 4 for controlling the second base 3 according to an amount of movement and a pneumatic actuator 5 for controlling the pressure of the second base 3. The feed screw means 4 and the pneumatic actuator 5 are each connected to a controller 8 and can be properly switched in response to a grinding step. Further, a position sensor (not shown) always detects the positions of the workpiece "a" to be ground and the grinding wheel b. Based on detected position information, a piezoelectric element and a super-magnetostrictive element making up the attitude controller 7 (described later) are expanded. Thus the misalignment of the axes of the rotators 6*a* and 6*b* can be properly corrected.

The feed screw means 4 has a nut 42 rotatably screwed onto a feed screw 41 mounted on the output shaft of a servo motor 43, and the nut 42 is attached to the second base 3. Moreover, the nut 42 and the second base 3 can be detached from each other.

On the other side 32 making up the second base 3, a through hole where the feed screw 41 is loosely fit is bored. The pneumatic actuators 5 are fixed on the right and left of the loosely fit feed screw 41. The pneumatic actuators 5 have different kinds of pressure performance. For example, one of the pneumatic actuators 5 relatively acts on a low-pressure area and the other pneumatic actuator 5 relatively acts on a high-pressure area. For example, the pneumatic actuator 5 has a piston rod slidably disposed in a cylinder.

In the initial grinding step (first step), the first base 3 is connected to the nut 42, the nut 42 is moved by a fixed amount in response to the driving of the servo motor 43, and the second base 3 (the rotator 6*b* placed on the second base 3) can be also moved by the fixed amount according to the movement of the nut 42. The initial grinding step includes, for example, a rough grinding step and the subsequent semi-finishing step. In the rough grinding step, grinding is performed step-by-step with #400 to #800 diamond grinding wheels. In the semi-finishing step, grinding is performed step-by-step with #3000 to #30000 diamond grinding wheels. Further, during the step-by-step diamond grinding, the feed rate of the grinding wheel is also adjusted so as to change step-by-step (the feed rate gradually decreases).

On the other hand, in the ultraprecision grinding step (second step) of the first step, the second base 3 and the nut 42 are disconnected from each other. In this state, the pneumatic actuator 5 acting on the high-pressure area is driven. The second base 3 is pressed to the first base 2 while an end of a piston rod (not shown) making up the pneumatic actuator 5 presses a plate (not shown), that is, while a reaction force is applied to the plate (not shown). The plate is fixed to the nut 42 and the nut 42 is screwed onto the feed screw 41, so that the reaction force sufficiently pressing the second base 3 can be received. In ultraprecision machining, the used pneumatic actuator 5 is switched to the pneumatic actuator 5 acting on the low-pressure area after constant pressure grinding is performed step-by-step on the high-pressure area. As in the case of the high-pressure area, constant pressure grinding is performed step-by-step on the low-pressure area.

FIG. 3 shows the embodiment of the attitude controller 7. FIG. 4 is a view taken along line IV-IV of FIG. 3. The attitude controller 7 includes a housing having an open top. The housing is made up of a first face member 71 and side walls 711. Such a housing can be formed of, for example, stainless steel. A second face member 72 is attached to the side walls 711 via second actuators 75. In this configuration, a given clearance L is obtained between the first face member 71 and the second face member 72, so that even when the second face member 72 is inclined, the second face member 72 does not interfere with the first face member 71. In the illustrated embodiment, in addition to the second actuators 75, a plurality of springs 77 are disposed between the side walls 711 and the second face member 72 to keep the second face member 72 in the X-Y plane.

The second actuator 75 is made up of a shaft member 75*c* having proper stiffness, a super-magnetostrictive element 75*a*, and a piezoelectric element 75*b*. The super-magnetostrictive element 75*a* has a coil (not shown) wound around the element and can be expanded by a magnetic field generated by passing current through the coil. The piezoelectric element 75*b* can be also expanded by the action of voltage. Further, a given current or voltage (not shown) can be caused to act on the super-magnetostrictive element 75*a* or the piezoelectric element 75*b* according to position information on an object (e.g., a rotator and the like) placed on the second face member 72. The position information is obtained by a sensor for detecting the position of the placed object. Further, the super-magnetostrictive element 75*a* and the piezoelectric element 75*b* are selectively activated when necessary in response to a machining step, to be specific, depending upon whether or not the second face member 72 has to be moved to a relatively large extent. In this case, the super-magnetostrictive element 75*a* can be formed of a rare-earth metal such as dysprosium and terbium and an alloy of iron and nickel as in the conventional art. The piezoelectric element 75*b* can be formed of titanate zirconate ($Pb(Zr,Ti)O_3$), barium titanate ($BaTiO_3$), lead titanate ($PbTiO_3$), or other generally used ceramic piezoelectric materials.

For example, in the case where the attitude controller 7 is placed on the first base 2, the second actuators 75, 75 are activated when the second face member 72 is displaced on the X-Y plane (horizontal direction) and first actuators 76, 76 are activated when the second face member 72 is displaced in the Z direction (vertical direction). Like the second actuator 75, the first actuator 76 is made up of a shaft member 76*c* having proper stiffness, a super-magnetostrictive element 76*a*, and a piezoelectric element 76*b*.

Between the first face member 71 and the second face member 72, a sphere 73 is disposed in addition to the first actuators 76, 76. FIG. 5 is a sectional view showing the detail of the sphere 73.

The sphere 73 is made up of a spherical core 73*a* which is made of, for example, a metal and a coating 73*b* which is provided around the core 73*a* and is made of, for example, graphite. Further, a coating made of an adhesive 74 elastically deformable at room temperature is formed around the coating 73*b*. In this case, as the adhesive 74, an adhesive (elastic epoxy adhesive) is available which has, for example, a tensile shear strength of 10 Mpa to 15 Mpa, an attenuation coefficient of 2 Mpa·sec to 7 Mpa·sec, preferably 4.5 Mpa·sec, a spring constant of 80 GN/m to 130 GN/m, preferably 100 GN/m. The thickness of the adhesive can be set at about 0.2 mm.

On a point where the first face member 71 and the second face member 72 come into contact with the sphere 73, cutouts 71*a* and 72*a* are cut. The sphere 73 is positioned by storing a part of the sphere 73 into the cutouts 71*a* and 72*a*. Further, the adhesive 6 covering the outer periphery of the sphere 73 is bonded to the cutouts 21*a* and 22*a*; meanwhile the adhesive 6 is separated from the sphere 73 (the coating 73*b* making up the sphere 73) and thus the sphere 73 can freely rotate in the coating of the adhesive 74.

When attitude control is performed on the rotator 6*a* placed on the second face member 72 while the first actuators 76 and the second actuators 75 are activated, a three-dimensional free displacement of the second face member 72 can be tolerated by the elastic deformation of the coating made of the adhesive 74. At this moment, the core 73*a* making up the sphere 73 supports the weight of the rotator 6*a* but just rotates on a fixed position without restricting the outer coating made of the adhesive 74. Therefore, the sphere 73 just supports the weight of the rotator 6*a*. The sphere 73 and the adhesive 74 are not bonded to each other. Thus the adhesive 74 can be freely elastically deformed according to a displacement of the second face member 72 without being restricted by the sphere 73. For this reason, the second face member 72 is only restricted to quite a small extent by a reaction force caused by the elastic deformation of the adhesive 74.

In a method of grinding a workpiece (precision machining method) according to the present invention, the rough grinding to final ultraprecision grinding steps are performed using only the precision machining system 1. First, a diamond grinding wheel is used as the grinding wheel b and rough grinding is performed on the workpiece "a" to be ground while the second base 3 (rotator 6*b*) is moved by the feed screw means 4 by a predetermined amount, so that an intermediate workpiece to be ground is produced (first step). In this rough grinding step, the positions of the grinding wheel b and the workpiece "a" to be ground are detected. In the event of an angle deviation between the ground surface of the workpiece "a" to be ground and a surface of the grinding wheel, the deviation is properly corrected by the attitude controller 7.

Next, the grinding wheel is switched from the diamond grinding wheel to a grinding wheel for CMG. In this case, the pneumatic actuator 5 is operated and the grinding wheel for CMG is pressed onto the workpiece "a" to be ground while a fixed pressure in a relatively high-pressure area is changed step-by-step. In the final step of grinding, switching takes place to the pneumatic actuator 5 and the final grinding is performed on the workpiece "a" to be ground while a fixed pressure in a low-pressure area is similarly changed step-by-step. Also in the ultraprecision grinding step, the positions of the grinding wheel b and the workpiece "a" to be ground are detected all the time. In the event of an angle deviation between the ground surface of the workpiece "a" to be ground and the surface of the grinding wheel, the deviation is properly corrected by the attitude controller 7.

Example 1

Referring to FIGS. 6 to 8, the following will discuss comparative experimental results on a work surface obtained by fixed abrasive grains and a work surface obtained by free abrasive grains.

Table 1 roughly shows comparisons between the fixed abrasive grains and the free abrasive grains for each of hard and soft tools, regarding factors of a removal rate of surface defects, a shape, a surface roughness, and a work-affected layer.

TABLE 1

| Machine | Movement amount control (position control) | | Pressure control | |
|---|---|---|---|---|
| Tool | Fixed abrasive grain | | Free abrasive grain | |
| Tool softness/hardness | Hard | Soft | Hard | Soft |
| Removal rate | Medium to high | Low to medium | High | Low to medium |
| Shape | Good | Good | Satisfactory | Poor |
| Surface roughness | Medium | Not rough | Not rough | Very fine |
| Work-affected layer | Many to not many | Few | Not many to few | None |

Broadly speaking, according to Table 1, it is confirmed that machining with fixed abrasive grains is advantageous in view of a removal rate and a shape and machining with free abrasive grains is advantageous in view of the roughness of the work surface and a work-affected layer. In order to eliminate defects such as roughness on the work surface and improve the work-affected layer in machining with fixed abrasive grains, CMG (Chemo-Mechanical-Grinding) is used as a machining method with fixed abrasive grains, by which a chemical reaction is actively provided for grinding.

A grinding wheel for CMG is used which contains chemical active abrasive grains and an additive, so that a chemical reaction occurs between the grinding wheel and the workpiece to be ground and between a resin binder (an additive contained in the binder) and the workpiece to be ground. Thus a grinding wheel for CMG was made on an experimental basis by using abrasive grains ($Ce_2$, $SiO_2$) preferably reacting with a Si wafer, and the effect of the grinding wheel was examined. Table 2 shows the CMG machining conditions in the experiments.

TABLE 2

| | |
|---|---|
| Grinding wheel | Wet: grinding wheel for CMG |
| Workpiece to be ground | Si wafer |
| Revolutions per minute | 15 to 60 (rpm) |
| Pressure | 0.23 to 0.92 (kgf/cm$^2$) |
| Supply amount of working fluid | 10 (ml/min) |

In this case, a grinding fluid has a pH of 7 and 11. For comparisons with CMG, a sliced wafer, a commercial polished wafer, wafers (a grinding mirror surface, a grinding burn surface) to be ground with a diamond grinding wheel were used. When observing a work surface through a SEM photograph (scanning electron microscope photograph), the wafers (a grinding mirror surface, a grinding burn surface) to be ground with a diamond grinding wheel and a wafer obtained by CMG had more grinding marks than the polished wafer.

FIG. 6 shows examination results on the hardness of each test specimen skin. In FIG. 6, "a" represents the polished wafer, b represents the sliced wafer, c represents the wafer (grinding mirror surface) ground with a diamond grinding wheel, d represents the wafer (grinding burn surface) ground with a diamond grinding wheel, e represents the wafer (pH 7) obtained by CMG, and f represents the wafer (pH 11) obtained by CMG. In FIG. 6, the polished wafer has the minimum value and the wafer (grinding burn surface) ground with a diamond grinding wheel has the maximum value. Relative to the polished wafer, the wafer (grinding burn surface) ground with a diamond grinding wheel has work hardening of about 40% due to machining distortion. On the other hand, it is understood that the wafers obtained by CMG have lower hardness than the wafers ground with a diamond grinding wheel. Particularly, when the wafer has a pH of 11, the work hardness is further reduced but is 14% higher than that of the polished wafer. This is because a material can be removed with a small reaction force by a chemical reaction.

FIG. 7 shows analysis results on the composition of a surface of a Si wafer. The composition was analyzed using an XPS (X-ray photoelectron spectroscopy). In FIG. 7, "a" represents a polished wafer, b represents a sliced wafer, c represents a wafer (grinding mirror surface) ground with a diamond grinding wheel, d represents a wafer (grinding burn surface) ground with a diamond grinding wheel, e represents a wafer (pH 11) obtained by CMG, and f represents a wafer (pH 7) obtained by CMG. On the polished wafer, $SiO_2$ caused by natural oxidation was observed, though the amount of $SiO_2$ was small. In the wafer (grinding burn surface) ground with a diamond grinding wheel, $SiO_2$ components are contained more than Si. On the other hand, in the wafer obtained by CMG, the composition ratio of Si to $SiO_2$ is closest to that of the polished wafer. Since surface oxidation of Si is suppressed thus, it can be assumed that plastic deformation (machining distortion) causes less grinding heat in CMG.

Next, the test specimens were observed by etching the test specimens with an etchant of $HF:HNO_3:CH_3COOH=9:12:2$ at room temperature for 30 seconds. With this etchant, machining defects can be clarified. According to the observation, the influence of dislocation is hardly observed on the polished wafer but a number of etch pits are irregularly present on the sliced wafer. On the other hand, the etch pits on the grinding surface are characterized by the occurrence along the grinding marks. The wafer (grinding mirror surface) ground with a diamond grinding wheel has small etch pits but the number of the etch pits is quite large. Conversely, the wafer obtained by CMG has large etch pits and the number of the etch pits is small. Moreover, it was observed that the number of the etch pits further decreases with the pH value of a coolant.

FIG. 8 shows examination results on etch pit distributions relative to a depth from a surface. The etch pit distributions were examined after etching was further performed on the ground surfaces of the wafers (grinding mirror surface, grinding burn surface) ground with a diamond grinding wheel and the wafers (pH 7 and pH 11) ground by CMG. In FIG. 8, X represents the wafer (grinding mirror surface) ground with a diamond grinding wheel, Y represents the wafer (grinding burn surface) ground with a diamond grinding wheel, Z represents the wafer (pH 7) obtained by CMG, and W represents the wafer (pH 11) obtained by CMG. In the wafers (pH 7, pH 11) obtained by CMG, the depth of a dislocation is about 5 μm and the dislocation density is reduced to about a half to one third that of the wafer (grinding mirror surface) ground with a diamond grinding wheel.

The above experimental results proved that CMG method is an effective method by which the work-affected layer can be reduced and perfect abrasive grains can be formed during the machining of a Si wafer.

Example 2

The following will describe, based on experimental results, that machining time can be shortened by a method of performing a first step (grinding with a diamond grinding wheel) while changing the feed rate of a grinding wheel step-by-step. Table 3 shows the experimental results.

TABLE 3

| | |
|---|---|
| Grinding wheel | Diamond grinding wheel #400/#800 |
| Workpiece to be ground | 8-inch single-crystal silicon (727 μm in thickness) |
| Grinding wheel rotational speed | 1417 rev/min |
| Workpiece rotational speed | 43 rev/min |
| Coolant | Pure water (35 liters/min) |
| Feed rate | 10 μm/min to 110 μm/min |

The present experiments are comparative experiments among a constant speed, a speed change in two steps, and a speed change in three steps in a machining time during which the thickness of a wafer changes from about 730 μm to about 110 μm. In these experiments, two kinds of diamond grinding wheel (#400, #800) were used. FIG. 9 shows the results of a #400 diamond grinding wheel (SD400N100DK100) and FIG. 10 shows the results of a #800 diamond grinding wheel (SD8000N100DK100). Additionally, at an amount of cut of 50 μm or more, a change in the tangential component of force was not observed in both of the diamond grinding wheels (#400, #800) and machining could be stably performed to a thickness of 110 μm.

In FIG. 9, X represents a constant speed of 40 μm/min, Y represents a feed rate changing in two steps of 90 μm/min and 30 μm/min, Z represents a feed rate changing in three stages of 100 μm/min, 80 μm/min, and 30 μm/min. As a Si wafer gradually decreases in thickness, the Si wafer becomes irresistible to a large tangential component of force and is broken. Thus in the present experiments, the feed rate is changed in three stages. As is evident from FIG. 9, the feed rate changing in two or three stages can achieve about a half the machining time of grinding with the constant speed. As a matter of course, the feed rates of the present experiments could be changed when necessary.

In FIG. 10, X represents a constant speed of 10 μm/min, Y represents a constant speed of 30 μm/min, Z represents a feed rate changing in two steps of 40 μm/min to 30 μm/min. A comparison between Y and Z proves that the machining time can be shortened by about 20%.

As is evident from the above experimental results, a first step of grinding with a diamond grinding wheel depends on the assumption that the feed rate of the grinding wheel is reduced step-by-step, and it is concluded that the maximum feed rate is initially used in an efficient machining method.

Example 3

The following will describe experimental results on three factors considered to greatly affect the duration of the machining time of a second step during which grinding is performed with a grinding wheel for CMG. One of the factors is the roughness of the work surface of an intermediate ground workpiece machined in a first step, the second factor is the presence or absence of an angle deviation (alignment) between a surface of the workpiece ground in the first to second steps and the grinding surface of a grinding wheel, and the third factor is whether or not the ground workpiece should be unfastened from a rotator during the transition from the first step to the second step.

First, FIG. 11 shows experimental results obtained by examining a machining time required, in the second step, for test specimens having been machined in the first step with three different surface roughnesses. Table 4 shows the experimental conditions of the present experiments.

TABLE 4

| | |
|---|---|
| Grinding wheel | Grinding wheel for CMG |
| Workpiece to be ground | 8-inch single crystal silicon (grounded from the initial thickness of 730 μm) |
| Grinding wheel rotational speed | 500 rev/min |
| Workpiece rotational speed | 50 rev/min |
| Feeding conditions | Pressure control (0.07 MPa) |

In FIG. 11, X represents the case where the surface roughness (Ra) of the intermediate ground workpiece is 0.153 μm, Y represents the case where the roughness (Ra) is 0.018 μm, and Z represents the case where the roughness (Ra) is 1 nm (nanometer). As is evident from FIG. 11, the lower the surface roughness of the work surface of the workpiece to be ground is in the first step, the shorter the overall machining time is. In consideration of the reduction of the machining time required for the first step, as described above, it is desirable to perform multiple-stage feed control on the grinding wheel in the first step. In conclusion, the following method is the most efficient: initially, machining is performed with a relatively high feed rate while using a diamond grinding wheel having a large grain size, and the grain size of the used diamond grinding wheel is reduced and the feed rate of the grinding wheel is also reduced in each of the subsequent steps.

Example 4

Referring to FIG. 12, the following will describe experimental results on the machining time of a second step. The machining time varies depending upon the presence or absence of an angle deviation between a surface of a workpiece to be ground and the grinding surface of a grinding wheel in a first step to the second step.

In FIG. 12, X represents the presence of an angle deviation. In the present experiment, a deviation from a vertical plane is 0.046 degrees and a deviation to the horizontal direction is 0.0009 degrees. On the other hand, Y represents the absence of a deviation. As is evident from FIG. 12, the machining time required for the second step varies greatly depending upon the presence or absence of a deviation between the surface of the workpiece to be ground and the grinding surface of the grinding wheel.

When the unevenness on the surface of an intermediate ground workpiece was examined in both cases, the maximum observed unevenness was 0.5 μm in the absence of an angle deviation and the maximum observed unevenness was 6 μm in the presence of an angle deviation.

Considering the experimental results, it is preferable to perform grinding in the first step (rough grinding with a diamond grinding wheel) while tilting alignment on purpose to improve flatness and to perform control in the second step so as to prevent misalignment.

Example 5

Next, a wafer surface was observed after CMG in the case where a ground workpiece had been unfastened from a rotator and in the case where the workpiece had not been unfastened from the rotator during the transition from a first step to a second step.

As a result of the observation, an uneven pattern was confirmed on a surface of a test specimen which is unfastened from the rotator, whereas an uneven pattern was not confirmed on a test specimen which is not unfastened from the rotator. Thus it can be concluded that the ground workpiece is distorted during unfastening by a residue stress generated in a diamond grinding step and the distortion causes the uneven pattern on the surface of the workpiece.

Therefore, it should be noted that the intermediate ground workpiece fastened to the rotator should not be unfastened during the transition from the first step to the second step.

Example 6

Finally, referring to FIGS. 13 to 20, the following will describe comparative observation results on the properties of the work surfaces of a wafer obtained by CMG method and a wafer obtained by CMP method.

FIG. 13 shows a TEM image (transmission electron microscope image) on the cross section of the wafer obtained by CMG method. FIG. 14*a* shows component analysis results on a portion A (near the surface) of FIG. 13 and FIG. 14*b* shows component analysis results on a portion B (inside) of FIG. 13. It is understood that lattice defects and the like were not recognized on the surface of the wafer and inside the wafer as shown in FIG. 13 and only Si was detected as an element as shown in FIG. 14. Additionally, recognized elements including Cu, Au and W in FIG. 14 are materials used for a protective film during the production of a TEM sample and thus these materials were not generated by CMG method.

FIG. 15 shows a TEM image on the cross section of the wafer obtained by CMP method. FIG. 16*a* shows component analysis results on a portion A (near the surface) of FIG. 15 and FIG. 16*b* shows component analysis results on a portion B (inside) of FIG. 15. FIG. 15 shows a $SiO_2$ layer recognized on the surface of the wafer. FIG. 16*a* shows the detection of the peak of oxygen.

FIG. 17*a* shows a TEM image on a surface of an extra-thin wafer obtained by CMG method. FIG. 17(*b*) shows a selected-area electron diffraction pattern on the surface of the extra-thin wafer. FIG. 18(*a*) shows a TEM image on a surface of a wafer obtained by CMP method. FIG. 18(*b*) shows a selected-area electron diffraction pattern on the surface of the wafer. A comparison between FIGS. 17 and 18 exhibits a definite difference. The surface of the wafer obtained by CMG method is a perfect surface, whereas the surface of the wafer obtained by CMP method has a halo unique to an amorphous material as well as Si spots. The presence of the halo suggests that an amorphous $SiO_2$ layer is present on the work surface of the wafer.

FIGS. 19 and 20 show, through an AFM (an atomic force microscope), patterns on the surfaces of wafers having been machined by CMG method and CMP method. Marks made by a CMG method fixed grinding wheel were clearly recognized on the wafer obtained by CMG method and the wafer had a perfect surface with quite a small surface roughness (Ra) of 0.16 nm. On the other hand, irregular marks were recognized on the wafer obtained by CMP method and it was found that the wafer had a surface roughness (Ra) of 0.36 nm, which was at least twice that of CMG method.

The above experimental results proved that the precision machining method of the present invention can simultaneously satisfy improvement in efficiency and increase in machining accuracy. Further, it was clearly confirmed that CMG method can achieve more accurate wafer processing than a conventional CMP method.

The embodiment of the present invention was specifically described with reference to the accompanying drawings. The specific configuration is not limited to this embodiment. Design changes and the like within the gist of the present invention are also included in the present invention.

The invention claimed is:

1. A precision machining method using a precision machining system comprising a first rotator for rotating a workpiece to be ground, a first base for supporting the first rotator, a second rotator for rotating a grinding wheel, and a second base for supporting the second rotator, at least one of the first base and the second base further comprising movement adjusting means capable of moving one of the first and second bases relative to the other of the first and second bases, the movement adjusting means being capable of selectively performing control based on either an amount of movement of one of the first and second bases relative to the other of the first and second bases or a pressure between the workpiece to be ground and the grinding wheel, the method comprising:

a first step of producing an intermediate ground workpiece by grinding the workpiece with an intermediate-grinding wheel on the second rotator; and a second step of producing a final ground workpiece by grinding the intermediate ground workpiece with a final-grinding wheel on the second rotator;

wherein the intermediate-grinding wheel is a diamond grinding wheel;

wherein the final-grinding wheel is a grinding wheel for CMG that differs from the intermediate-grinding wheel;

wherein in the first step, feed of at least one of the first rotator and the first base, and the second rotator and the second base, is controlled in multiple stages with different feed speeds according to the control based on the amount of movement of one of the first and second bases relative to the other of the first and second bases, and wherein in the second step, movement of at least one of the first rotator and the first base, and the second rotator and the second base, is controlled with a constant pressure between the workpiece to be ground and the final-grinding wheel or in multiple stages having different constant pressures between the workpiece to be around and the final-grinding wheel.

2. The precision machining method according to claim 1, wherein an attitude controller for controlling a rotator-attitude is disposed between the first rotator and the first base or between the second rotator and the second base, the method further comprising:

correcting an angle deviation between a ground surface of the workpiece to be ground and a surface of the intermediate-grinding wheel during the first step with the attitude controller; and correcting an angle deviation between a ground surface of the intermediate workpiece and a surface of the final-grinding wheel during the second step with the attitude controller.

3. The precision machining method according to claim 1 or 2, wherein the workpiece is fastened to the first rotator, and wherein the method further comprises shifting from the first step to the second step without unfastening the workpiece from the first rotator.

* * * * *